US007229393B2

(12) United States Patent
Liang et al.

(10) Patent No.: US 7,229,393 B2
(45) Date of Patent: Jun. 12, 2007

(54) RESISTANCE ADJUSTABLE EXERCISE DEVICE

(76) Inventors: Kung-Tai Liang, No.628-11, Lumei Rd., Changhua City (TW); Chang-I Lin, No.603, 6F-1, Jingguo Rd., Taoyuan City (TW)

( * ) Notice: Subject to any disclaimer, the term of this patent is extended or adjusted under 35 U.S.C. 154(b) by 682 days.

(21) Appl. No.: 10/795,307

(22) Filed: Mar. 9, 2004

(65) Prior Publication Data

US 2005/0209071 A1 Sep. 22, 2005

(51) Int. Cl.
*A63B 21/00* (2006.01)

(52) U.S. Cl. ..... 482/130; 482/121

(58) Field of Classification Search ..... 482/121, 482/124–127, 130, 140, 142, 129; 124/25.6, 124/900
See application file for complete search history.

(56) References Cited

U.S. PATENT DOCUMENTS 4,294,221 A * 10/1981 Bryant ..... 124/25.6
4,725,057 A * 2/1988 Shifferaw ..... 482/130
6,146,317 A * 11/2000 Prusick ..... 482/130
7,041,041 B1 * 5/2006 Evans ..... 482/126

* cited by examiner

*Primary Examiner*—Jerome Donnelly
(74) *Attorney, Agent, or Firm*—Rosenberg, Klein & Lee

(57) ABSTRACT

A flexible stick of a bow exercise device includes a base and a top cap, and a first and second flexible plates are connected between the base and the top cap. Two ends of the first flexible plate are respectively connected to the base and the top cap. A first end of the second flexible plate is connected to the base and a second end of the second flexible plate is movably inserted in a slot defined in the top cap. A gap is defined between the first and second flexible plates when the stick is not bent. The top cap can be removed from the two flexible plates and the second flexible plate can be replaced with another one with different flexibility.

5 Claims, 8 Drawing Sheets

RESISTANCE ADJUSTABLE EXERCISE DEVICE

FIELD OF THE INVENTION

The present invention relates to a bow exercise device which includes at least two flexible plates and one of which is fixed between a top cap and a base, the other flexible plate is shorter and has one end movable in the top cap.

BACKGROUND OF THE INVENTION

A conventional bow exercise device is disclosed in FIGS. 7 and 8, and generally includes a plurality of flexible sticks 40 as shown. The stick 40 includes a cylindrical body 41 and a base 43 is connected to a lower end of the body 41 so as to be fixed to a frame which is not shown, and a top cap 42 is connected to a top of the body 42. The top cap 42 has a lug 421 with a hole 422 defined through. A rope (not shown) is tied to the lug 421 at the hole 422 and pulled by the users. The users have pull the rope to bow the body 41 so as to exercise the muscles. Nevertheless, the body 41 has a fixed flexibility so that the resistance force of the body 41 cannot be adjusted. In other words, the exercise device has to equip a plurality of sticks 40 of different diameters and flexibility. Besides, due to the integral structure of the stick 40, the diameter of the stick 40 has to be increased if a larger resistance is required, and this involves a high cost.

The present invention intends to provide a stick that includes at least one flexible plate which has one end movably inserted in the top cap such that the stick has better flexibility.

SUMMARY OF THE INVENTION

The present invention relates to a bow exercise device which comprises a frame and at least one stick is connected to the frame. The at least one stick is composed of a base, a top cap, a first flexible plate and a second flexible plate. The two flexible plates are connected between the base and the top cap. The second flexible plate is shorter than the first flexible plate and two respective first ends of the first and second flexible plates are connected to the base. The top cap has a lug and can be removed from the respective second ends of the first and second flexible plates, such that the second flexible plate can be replaced with another plate. A pull member is connected to the lug.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIGS. 4A, 4B and 4C shows three positions of the movement of the second end of the second flexible plate in the top cap when the stick is bent;

DETAILED DESCRIPTION OF THE PREFERRED EMBODIMENT

Figure 1:
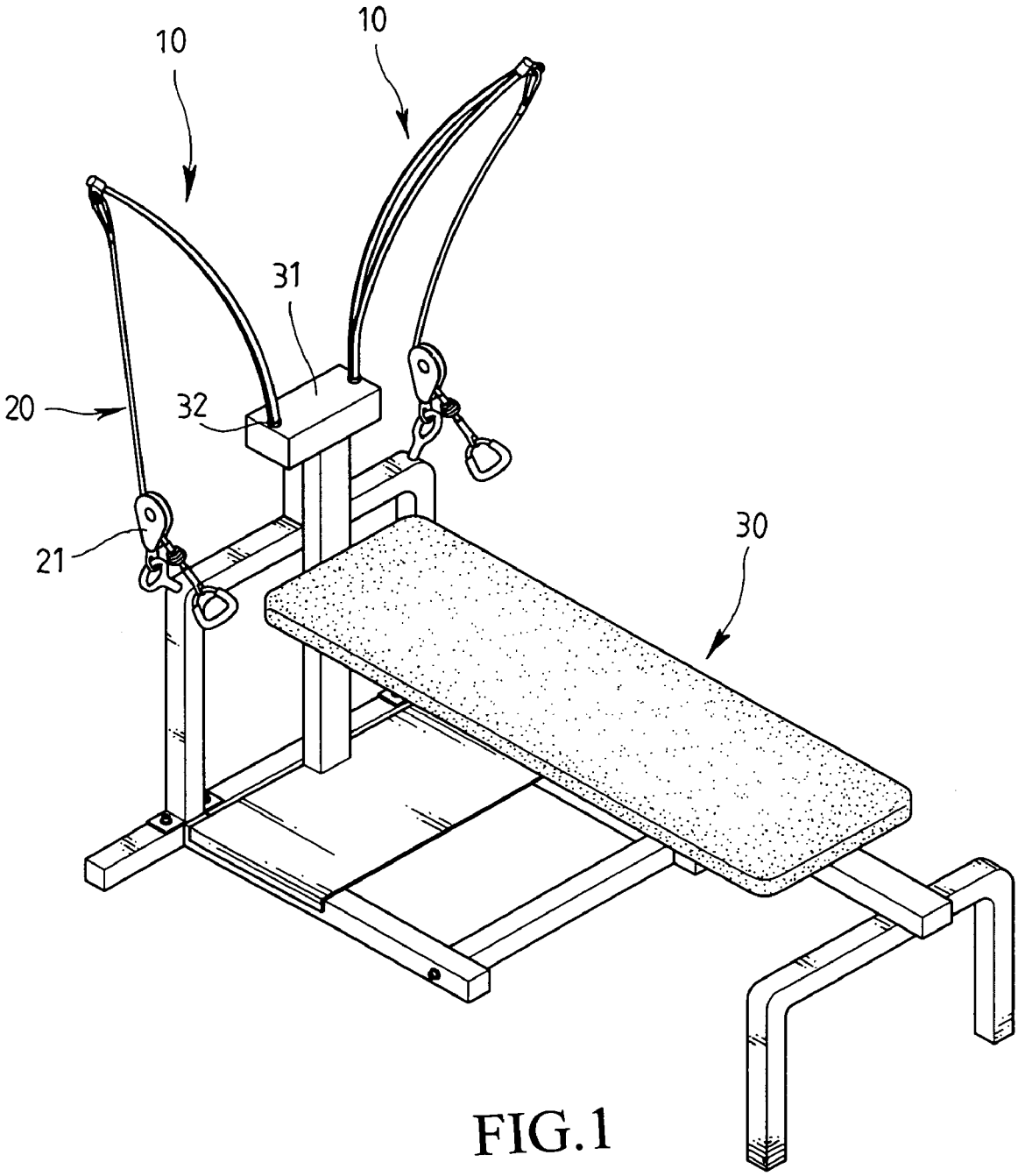
FIG. 1 is a perspective view to show the bow exercise device of the present invention.
Figure 2:
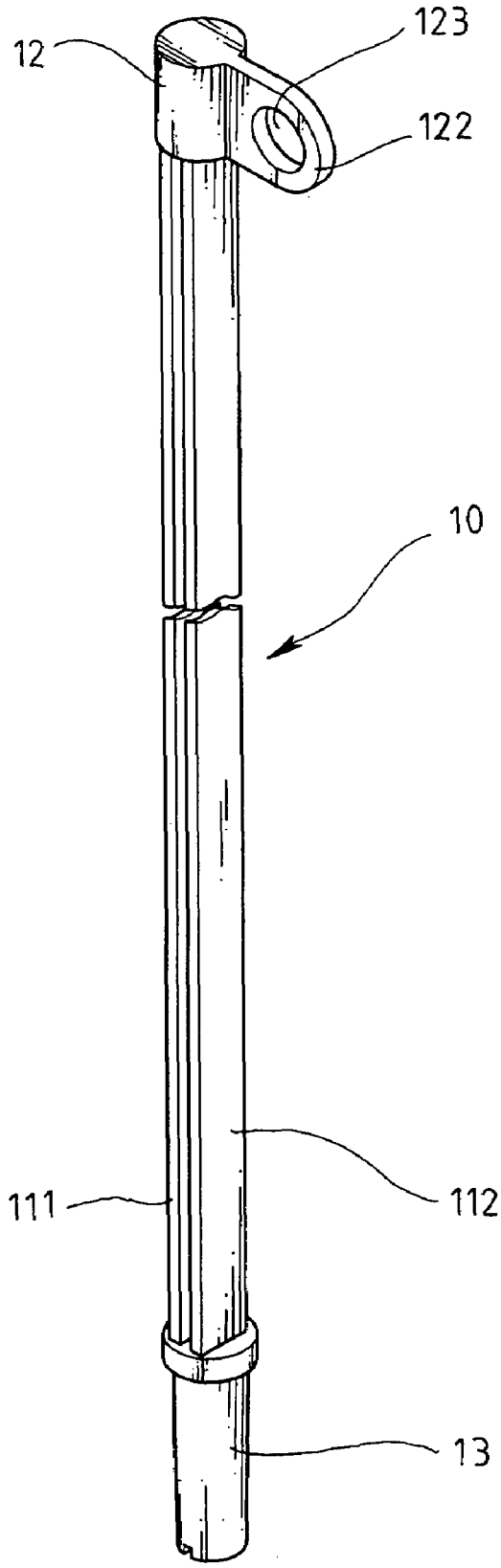
FIG. 2 is a perspective view to show the stick of the bow exercise device of the present invention.
Figure 8:
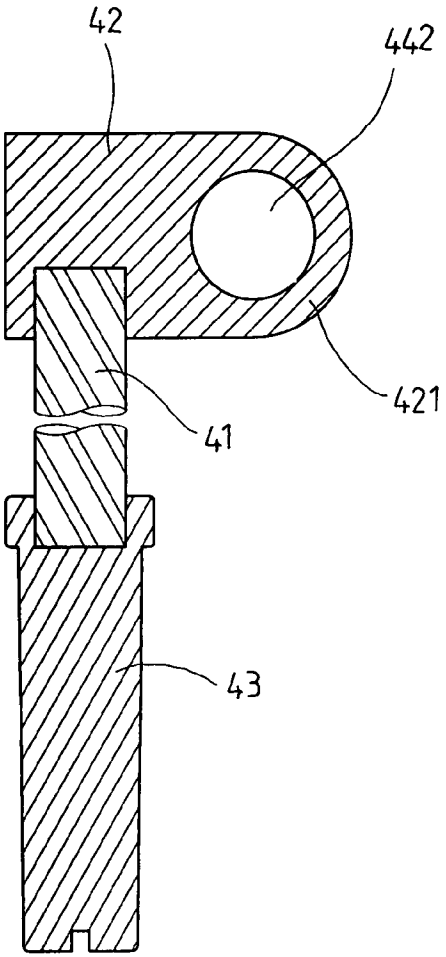
FIG.8 PRIOR ART
FIG. 8 is a cross sectional view to show the connection of the cylindrical body and the top cap of the conventional stick.
Figure 3:
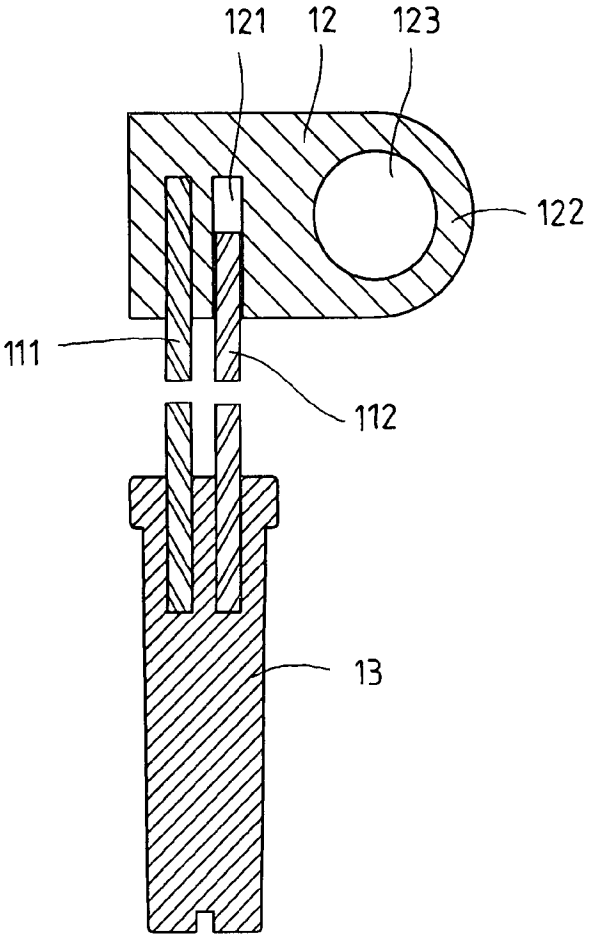
FIG. 3 is a cross sectional view to show the connection of the two flexible plates and the top cap.
Figure 4:
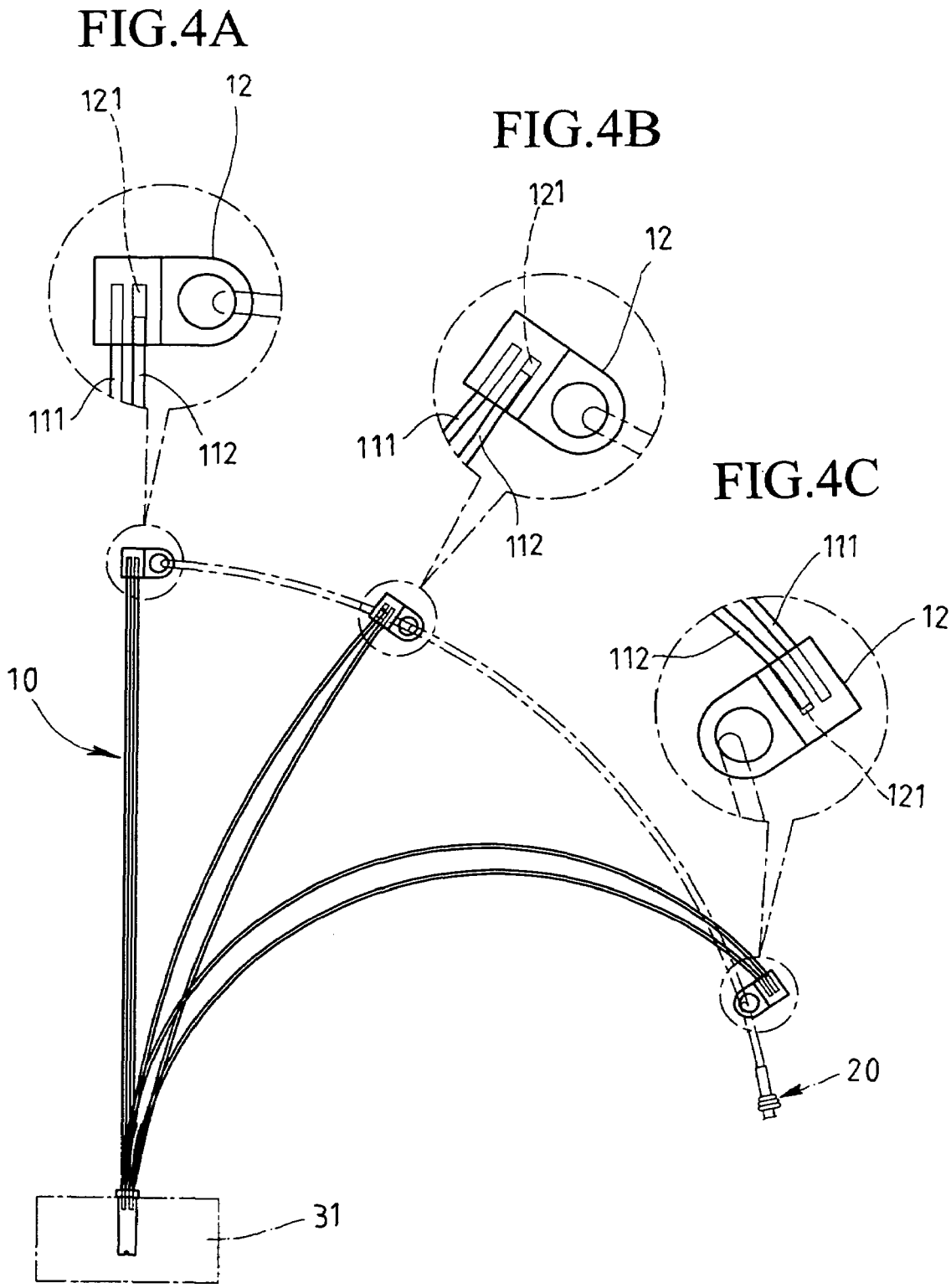
FIG. 4 shows the stick is bent by pulling the pull member.

Referring to FIGS. 1 to 3, the bow exercise device of the present invention comprises a frame 30 which includes support legs and a bench is connected to the frame. A stand 31 is located at an end of the frame 30 and two recesses 32 are defined in a top of the stand 31.

Two sticks 10 are connected to the two recesses 32 of the stand 31 and each stick 10 includes a base 13, a first flexible plate 111 and a second flexible plate 112, and a top cap 12. The second flexible plate 112 is shorter than the first flexible plate 111. Two respective first ends of the first and second flexible plates 111, 112 are inserted into the base 13 which is inserted in one of the recesses 32. The top cap 12 has a lug 122 with a hole 123 defined therethrough. A second end of the first flexible plate 111 is removably connected to the base 13, and a second end of the second flexible plate 112 is movably inserted in a slot 121 defined in the top cap 12. The slot 121 in the top cap 12 has a space not occupied by the second end of the second flexible plate 112 when the stick is not bent. Two pull members 20 are respectively connected to the lugs 122 of the two top caps 12 at the holes 123. Each pull member 20 reeves through a pulley which is anchored at a ring connected to the frame 30. It is noted that a gap is defined between the first flexible plate 111 and the second flexible plate 112 when the stick 10 is not bent.

Referring to FIGS. 4, 4*a*, 4B and 4C, when pulling the pull member 20, the stick 10 is bent and the second end of the second flexible plate 112 is moved toward a close end of the slot 121 at different positions so that the stick 10 is allowed to be bent further. The users are exercised by overcoming the reaction force of the first and second flexible plates 111, 112.

Figure 5:
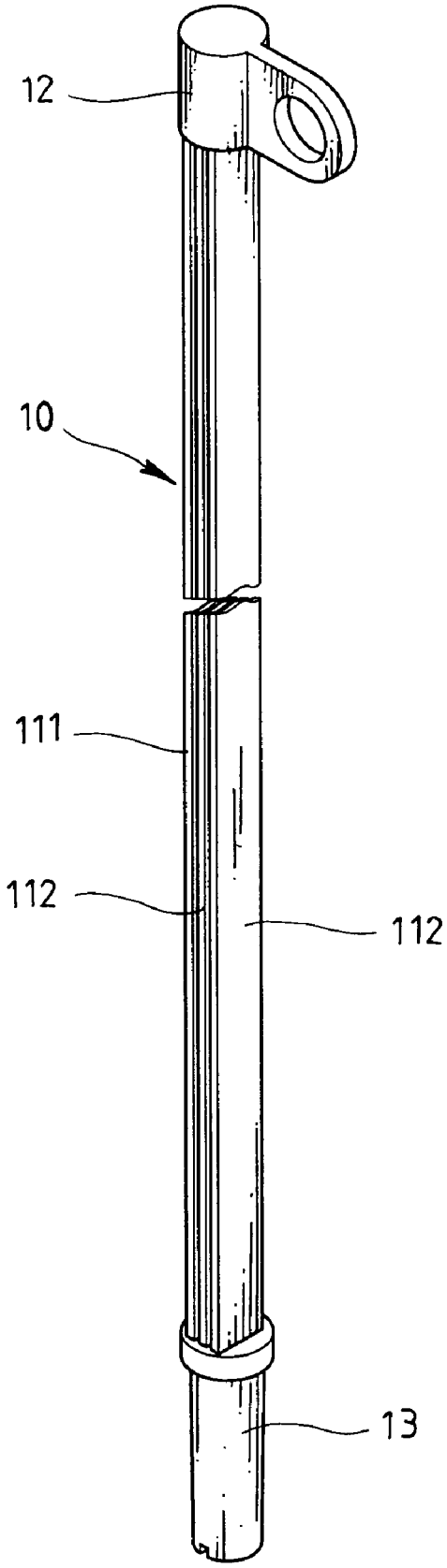
FIG. 5 shows the stick includes three flexible plates.

Referring to FIG. 5, the stick 10 may include one first flexible plate 111 and two second flexible plates 112 of different lengths. The top cap 12 may have two slots that have different depths so that different curvatures can be achieved for the two second flexible plates 112. It is noted that the top cap 12 can be removed from the flexible plates 111, 112 so as to replace the flexible plates of different flexibility such that the resistance or the reaction force of the sticks 10 can be adjusted.

Figure 6:
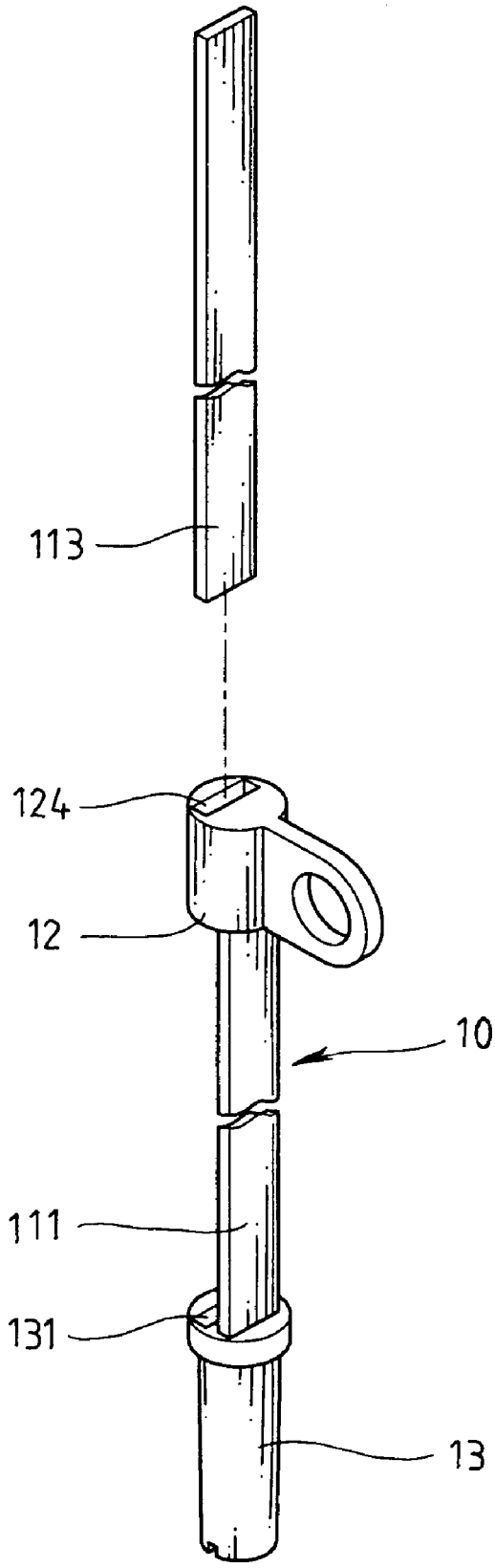
FIG. 6 shows the top cap has a through passage through which the third flexible plate extends.
Figure 6A:
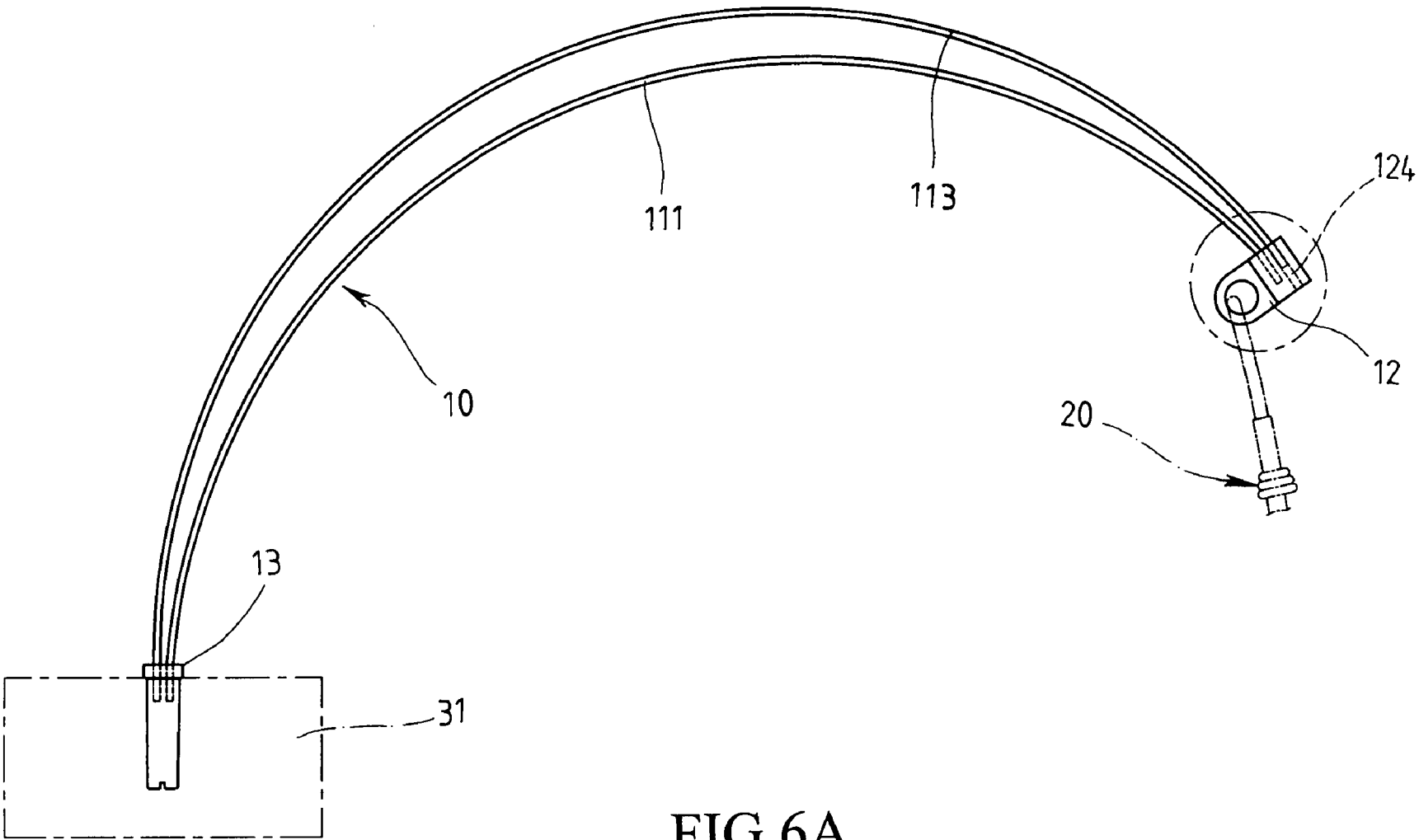
FIG. 6A shows that the stick as shown in FIG. 6 is bent.
Figure 7:
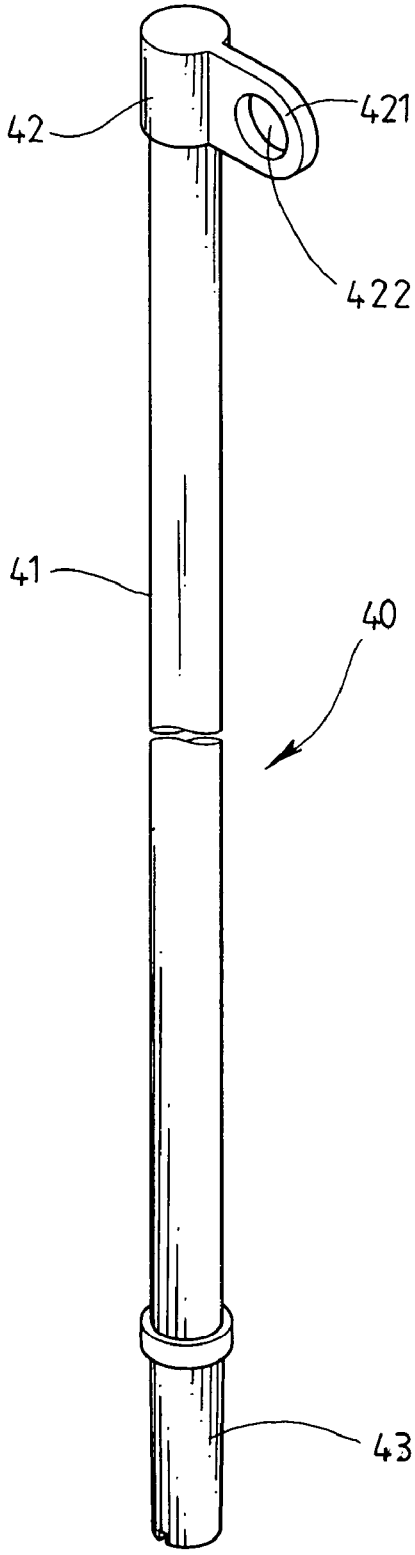
FIG.7 PRIOR ART
FIG. 7 shows a conventional stick of the bow exercise device.

Referring to FIGS. 6 and 6A, the top cap 12 may include a through passage 124 and the base 13 has an insertion hole 131, so that a third flexible plate 113 may extend through the through passage 124 and has one end thereof inserted in the insertion hole 131 in the base 13. By this arrangement, the third flexible plate 113 can be conveniently replaced by another one with different flexibility via the through passage 124.

While we have shown and described the embodiment in accordance with the present invention, it should be clear to those skilled in the art that further embodiments may be made without departing from the scope of the present invention.

What is claimed is:

1. A bow exercise device comprising:

a frame;

at least one stick comprising a base connected to the frame and two respective first ends of a first flexible plate and a second flexible plate respectively inserted into the base;

a top cap, a second end of the first flexible plate removably connected to the top cap, a second end of the second flexible plate removably inserted in a slot defined in the top cap, the top cap having a lug, and a pull member connected to the lug.

2. The device as claimed in claim 1, wherein a gap is defined between the first flexible plate and the second flexible plate when the at least one stick is not bent.

3. The device as claimed in claim 1, wherein the slot in the top cap has a space not occupied by the second end of the second flexible plate when the stick is not bent.

4. The device as claimed in claim 1, wherein the top cap includes a through passage, a third flexible plate extending through the through passage and having one end thereof inserted in the insertion hole in the base, the other end of the third flexible plate being located in the through passage.

5. The device as claimed in claim 1, wherein the second flexible plate is shorter than the first flexible plate.

* * * * *